US010478677B2

(12) United States Patent
Gump et al.

(10) Patent No.: US 10,478,677 B2
(45) **Date of Patent: *Nov. 19, 2019**

(54) SPORTS TRAINING BALL AND METHOD OF MANUFACTURING A SPORTS TRAINING BALL

(71) Applicant: SWAX LAX LLC, Summit, NJ (US)

(72) Inventors: Laura Gump, Summit, NJ (US); Jim Fitzgerald, Vida, OR (US)

(73) Assignee: SWAX LAX LLC, Summit, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/544,155

(22) PCT Filed: Jan. 22, 2016

(86) PCT No.: PCT/US2016/014500

§ 371 (c)(1),
(2) Date: Jul. 17, 2017

(87) PCT Pub. No.: WO2016/118846

PCT Pub. Date: Jul. 28, 2016

(65) Prior Publication Data

US 2018/0008868 A1 Jan. 11, 2018

Related U.S. Application Data

(60) Provisional application No. 62/141,660, filed on Apr. 1, 2015, provisional application No. 62/106,476, filed on Jan. 22, 2015.

(51) Int. Cl.
*A63B 37/02* (2006.01)
*A63B 37/12* (2006.01)
(Continued)

(52) U.S. Cl.
CPC ..... *A63B 37/12* (2013.01); *A63B 37/06* (2013.01); *A63B 45/00* (2013.01);
(Continued)

(58) Field of Classification Search
CPC ..... A63B 37/12; A63B 37/06; A63B 45/00; A63B 37/02; A63B 2037/082;
(Continued)

(56) References Cited

U.S. PATENT DOCUMENTS 2,093,737 A 4/1937 Reach
2,081,531 A * 5/1937 Fegan ..... A63B 37/00 273/DIG. 15
(Continued)

FOREIGN PATENT DOCUMENTS

WO 02/089925 A1 11/2002
WO 2008/097711 A2 8/2008
(Continued)

OTHER PUBLICATIONS

"The Engineering Toolbox: Densities of Common Materials", <https://www.engineeringtoolbox.com/density-materials-d_1652.html>, retrieved on Jul. 3, 2018.*
(Continued)

*Primary Examiner* — Steven B Wong
(74) *Attorney, Agent, or Firm* — Hoffman & Baron, LLP

(57) ABSTRACT

A lacrosse training ball that is made up of a shell that defines an enclosure having an interior volume is disclosed. The shell includes a plurality of pads connected along a plurality of seams sewn with a thread having a finishing knot. The interior volume is substantially occupied by a filler that includes a mixture of a first material and a second material.

19 Claims, 15 Drawing Sheets

(51) Int. Cl.

| | |
|---|---|
| ***A63B 45/00*** | (2006.01) |
| ***A63B 37/06*** | (2006.01) |
| *A63B 102/20* | (2015.01) |
| *A63B 102/14* | (2015.01) |
| *A63B 102/34* | (2015.01) |
| *A63B 102/22* | (2015.01) |
| *A63B 102/18* | (2015.01) |

(52) U.S. Cl.
CPC ..... *A63B 2037/125* (2013.01); *A63B 2102/14* (2015.10); *A63B 2102/18* (2015.10); *A63B 2102/182* (2015.10); *A63B 2102/20* (2015.10); *A63B 2102/22* (2015.10); *A63B 2102/34* (2015.10); *A63B 2208/12* (2013.01); *A63B 2243/0033* (2013.01)

(58) Field of Classification Search
CPC ..... A63B 2102/018; A63B 2037/125; A63B 2102/182; A63B 2102/14; A63B 2208/12; A63B 2243/0033; A63B 2102/20; A63B 2102/34; A63B 2102/22; A63B 2043/001; A63B 2071/0063
See application file for complete search history.

(56) References Cited

U.S. PATENT DOCUMENTS

| | | | | | |
|---|---|---|---|---|---|
| 2,138,004 | A * | 11/1938 | Grau, Jr. | B29D 99/0042 | 156/170 |
| 2,494,806 | A | 1/1950 | Gibson | | |
| 2,840,024 | A * | 6/1958 | Haas | A63B 37/12 | 112/400 |
| 3,069,170 | A | 12/1962 | Dillon, Jr. | | |
| 3,480,280 | A * | 11/1969 | Gamertsfelder | A63B 67/06 | 473/594 |
| D232,957 | S * | 9/1974 | Kahelin | 473/597 | |
| 4,151,994 | A * | 5/1979 | Stalberger, Jr. | A63B 37/02 | 273/DIG. 4 |
| 4,354,679 | A * | 10/1982 | Steinmetz | A63B 43/002 | 473/594 |
| 4,448,418 | A * | 5/1984 | McNeill | A63B 43/04 | 273/123 A |
| 4,643,424 | A * | 2/1987 | Nakajima | A63B 37/00 | 264/239 |
| D292,014 | S * | 9/1987 | Stalberger, Jr. | D21/713 | |
| 4,872,676 | A * | 10/1989 | Townsend | A63B 37/08 | 473/413 |
| 4,880,233 | A | 11/1989 | Song | | |
| 4,943,066 | A * | 7/1990 | Lathim | A63B 37/02 | 473/576 |
| 5,007,639 | A * | 4/1991 | Watson | A63B 37/02 | 473/602 |
| 5,040,795 | A | 8/1991 | Sonntag | | |
| 5,286,020 | A | 2/1994 | Caruso | | |
| 5,310,178 | A | 5/1994 | Walker et al. | | |
| 5,492,320 | A * | 2/1996 | Hoffman | A63B 67/06 | 473/594 |
| 5,566,953 | A * | 10/1996 | Arriola | A63B 37/02 | 473/594 |
| 5,655,777 | A * | 8/1997 | Neading | A63B 65/08 | 473/594 |
| 5,688,198 | A | 11/1997 | Teifert et al. | | |
| 5,711,729 | A | 1/1998 | Chan | | |
| 5,772,543 | A * | 6/1998 | Paino | A63B 37/02 | 273/DIG. 30 |
| 5,788,591 | A * | 8/1998 | Decker | A63B 37/00 | 473/602 |
| 5,813,932 | A * | 9/1998 | Grafton | A63B 37/02 | 473/594 |
| 5,820,501 | A | 10/1998 | Soofi | | |
| 5,830,034 | A | 11/1998 | Ciechanowski et al. | | |
| 5,848,946 | A * | 12/1998 | Stillinger | A63B 21/00189 | 473/594 |
| 5,893,811 | A * | 4/1999 | Stover | A63B 43/02 | 473/573 |
| 5,910,059 | A * | 6/1999 | Hanson | A63B 37/02 | 473/594 |
| D422,040 | S | 3/2000 | Stalberger, Jr. | | |
| 6,053,829 | A * | 4/2000 | Conley | A63B 37/02 | 473/594 |
| 6,645,098 | B1 * | 11/2003 | Quinn | A63B 43/04 | 473/594 |
| 6,663,520 | B2 | 12/2003 | Ou Chen | | |
| 7,211,012 | B2 | 5/2007 | Laliberty et al. | | |
| 7,247,107 | B1 * | 7/2007 | Bedwell | A63B 37/02 | 473/595 |
| 7,566,488 | B2 | 7/2009 | Mimura et al. | | |
| 7,785,219 | B2 | 8/2010 | Avis | | |
| 8,277,344 | B2 * | 10/2012 | Cea | A63B 43/06 | 473/570 |
| 2004/0018901 | A1 * | 1/2004 | Morrow | A63B 39/06 | 473/596 |
| 2004/0102265 | A1 | 5/2004 | Laliberty et al. | | |
| 2004/0142779 | A1 | 7/2004 | Chan | | |
| 2004/0142780 | A1 | 7/2004 | Estefano | | |
| 2005/0143205 | A1 * | 6/2005 | Yang | A63B 37/02 | 473/601 |
| 2005/0239584 | A1 * | 10/2005 | Willyerd | A63B 69/0002 | 473/600 |
| 2008/0020874 | A1 * | 1/2008 | Huang | A63B 37/00 | 473/602 |
| 2008/0051233 | A1 | 2/2008 | Nesbitt et al. | | |
| 2008/0064535 | A1 | 3/2008 | Herman | | |
| 2008/0194362 | A1 | 8/2008 | Helmer et al. | | |
| 2008/0242458 | A1 | 10/2008 | Winn | | |
| 2009/0209374 | A1 | 8/2009 | Ou | | |
| 2011/0165978 | A1 * | 7/2011 | Leefeldt | A63B 43/04 | 473/594 |
| 2011/0226824 | A1 * | 9/2011 | Altavilla | A45F 5/02 | 224/196 |
| 2011/0312433 | A1 * | 12/2011 | Parenti | A63B 39/04 | 473/280 |
| 2012/0142464 | A1 | 6/2012 | Smith et al. | | |
| 2014/0342859 | A1 | 11/2014 | Newman | | |
| 2014/0357149 | A1 * | 12/2014 | Canobbio | A63H 33/18 | 446/37 |
| 2015/0045152 | A1 * | 2/2015 | Hayes | A63B 39/00 | 473/446 |
| 2015/0328500 | A1 | 11/2015 | Hanson, Jr. et al. | | |
| 2016/0375317 | A1 * | 12/2016 | Connelly | A63B 39/00 | 473/606 |
| 2018/0008868 | A1 * | 1/2018 | Gump | A63B 37/12 | |
| 2018/0064999 | A1 * | 3/2018 | Gump | A63B 37/12 | |

FOREIGN PATENT DOCUMENTS

| | | |
|---|---|---|
| WO | 2013/006940 A1 | 1/2013 |
| WO | 2016/118846 A1 | 7/2016 |

OTHER PUBLICATIONS

International Search Report for International Application No. PCT/US2017/050402, dated Dec. 4, 2017.
Written Opinion for International Application No. PCT/US2017/050402, dated Dec. 4, 2017.
Supplementary Partial EP Search Report for European Application No. EP 16740825, dated Jul. 16, 2018 (12 pages).
"Hybrid Juggle Balls," Flying Clipper Juggling Supplies, Product Catalog, www.flyingclipper.com/tossaball-hybrid-juggling-balls, 3 pages (last accessed Nov. 13, 2017).
Campbell, Andrea, "The Great American Pastime: Baseball, Origins and Features", Bright Hub Education [online], Apr. 2014 [retrieved on Jul. 6, 2017]. Retrieved from the Internet: <URL: http://www.brighthubeducation.com/social-studies-help/128534-origins_and_features-of-baseball/> (3 pages).
International Search Report dated Jun. 3, 2016 issued in PCT/US2016/014500 (5 pages).

(56) References Cited

OTHER PUBLICATIONS

Written Opinion of the International Searching Authority dated Jun. 3, 2016 issued in PCT/US2016/014500 (9 pages).

* cited by examiner

SPORTS TRAINING BALL AND METHOD OF MANUFACTURING A SPORTS TRAINING BALL

CROSS-REFERENCE TO RELATED APPLICATIONS

This application is the National Stage of International Application No. PCT/US2016/014500 filed Jan. 22, 2016, which claims the benefit of U.S. Provisional Application No. 62/106,476 filed Jan. 22, 2015 and U.S. Provisional Application No. 62/141,660 filed Apr. 1, 2015, the contents of which are incorporated by reference herein in entirety.

BACKGROUND

The present disclosure describes technology related to a ball for use in a sporting activity. The technology is well suited for use in "hard-ball" sports such as baseball, lacrosse, and field hockey. Through the use of the techniques disclosed herein, a sporting goods manufacturer can generate sports balls that have advantages over those currently available. Such advantages include impact-absorbing qualities, softness, durability and improved safety for players. Sports balls with these qualities are able withstand repeated impacts that occur during training while also being less likely to cause injury upon impact and accordingly are better suited for training.

Injuries are one of the big obstacles to overcome in getting young people involved in sports. This is especially true for sports that involve playing with balls that have hard covers or hard outer surfaces. It is not unusual in such sports for inexperienced players to either misdirect the ball so that it strikes someone else or to lose track of the flight of the ball and inadvertently be struck by it. Each of these circumstances can result is significant injuries to players or bystanders of a sport.

The risk of such injuries can cause novices (especially children) to forego a sport altogether or, in the event that they do try to learn the sport, to have a more difficult time learning the sport due to a fear of being hit. Anxieties among novice players can be detrimental to the growth of popularity of a sport. Lacrosse is an example of a sport the popularity of which is growing but may be limited because it is played with a hard, heavy rubber ball. A lacrosse ball is an example of the type of ball that can cause anxiety in novice players. Some players are less likely to take up a sport such as lacrosse due to the protective equipment required for the game. Lacrosse balls that absorb impacts when they make contact reduce the importance of such protective equipment and thus may encourage greater participation in the sport.

A need exists for a sports training ball that flies and throws as a regulation ball but absorbs impact in the event of a collision. Such sports training balls allow players of the game to train in a safe and confident manner. To meet these requirements a ball needs to meet the specification of the game's governing body with regard to aerodynamic and physical (e.g., weight, air-resistance, and circumference) properties so that the training balls are similar to a ball that would be used in an official competition. However, for training purposes such a ball should absorb impact so as to minimize harm to players if or when they are struck and thereby minimize the anxieties of new players. Furthermore, a sports ball for use in training must be designed and built to maintain impact-absorption and aerodynamic properties through numerous impacts and through tough usage.

BRIEF SUMMARY

In accordance with a first embodiment, the subject application provides a lacrosse training ball that includes a shell defining an enclosure having an interior volume. The shell is made up of a plurality of pads connected along a plurality of seams that are sewn with a thread having a finishing knot. The sports ball further includes a filler that includes a mixture of a first material and a second material. The filler substantially occupies the interior volume.

In accordance with a second embodiment, a method of manufacturing a sports ball is provided wherein the sports ball is made by a series of steps including forming a first and a second hemispherical cup, each including a first spherical triangle shape, a second spherical triangle shape, a third spherical triangle shape, and a fourth spherical triangle shape from a first material. In the sports ball the first spherical triangle shape is attached to the second spherical triangle shape and the third spherical shape along a first longitudinal side, the fourth spherical triangle shape is attached to the second spherical triangle shape and the third spherical shape along a second longitudinal side to form a first hemispherical cup. The method of manufacturing includes a step of attaching the first hemispherical cup to the second hemispherical cup along a first, a second, a third, and a fourth latitudinal line to form a ball, wherein the fourth latitudinal line defines a packing gap. The method includes the steps of grinding a material to generate a plurality of pellets and combining the plurality of pellets with a plurality of grains of sand to form a filler. The filler is used to fill the ball via the packing gap with the filler and the first hemispherical cup is sewn to the second hemispherical cup to form a sewn seam that closes the packing gap.

In accordance with another embodiment, a sports ball that is made up of a shell comprising a plurality of pentagonal pouches is provided. Each pouch has a respective pouch interior volume and the shell defines a second interior volume. Each pouch interior volume is substantially occupied by a first filler (e.g., sand) having a first density. The second interior volume is substantially occupied by a second filler (e.g., rubber pellets) having a second density which is less than the first density.

An important aspect of sports training balls as disclosed herein is their durability. That durability is necessary to withstand the rigors of training in sports such as lacrosse. Unlike other sewn balls, lacrosse training balls require a strong thread and a particular method of tying off the thread so that, in the event that the fabric of the ball surface fails, the thread will not fail. This design feature is particularly important in developing a sports training ball that can withstand throws and collisions of greater than 70 mph (professional lacrosse players can crank a ball at speeds in excess of 100 M.P.H.) as is required in sports such as lacrosse.

In addition to the durability of sports training balls as disclosed herein a further advantageous quality relates to the lack of recoil upon impact in comparison to regulation lacrosse balls. Regulation lacrosse balls have a tendency to bounce and roll when they hit the ground. Sports training balls as described herein tend to stay closer to the training area in comparison.

BRIEF DESCRIPTION OF THE SEVERAL VIEWS OF THE DRAWINGS

The foregoing summary, as well as the following detailed description of several aspects of the subject application, will be better understood when read in conjunction with the appended drawings. For the purpose of illustrating the subject application there are shown in the drawings several aspects, but it should be understood that the subject application is not limited to the precise arrangements and instrumentalities shown.

In the drawings.

DETAILED DESCRIPTION

Figure 1:
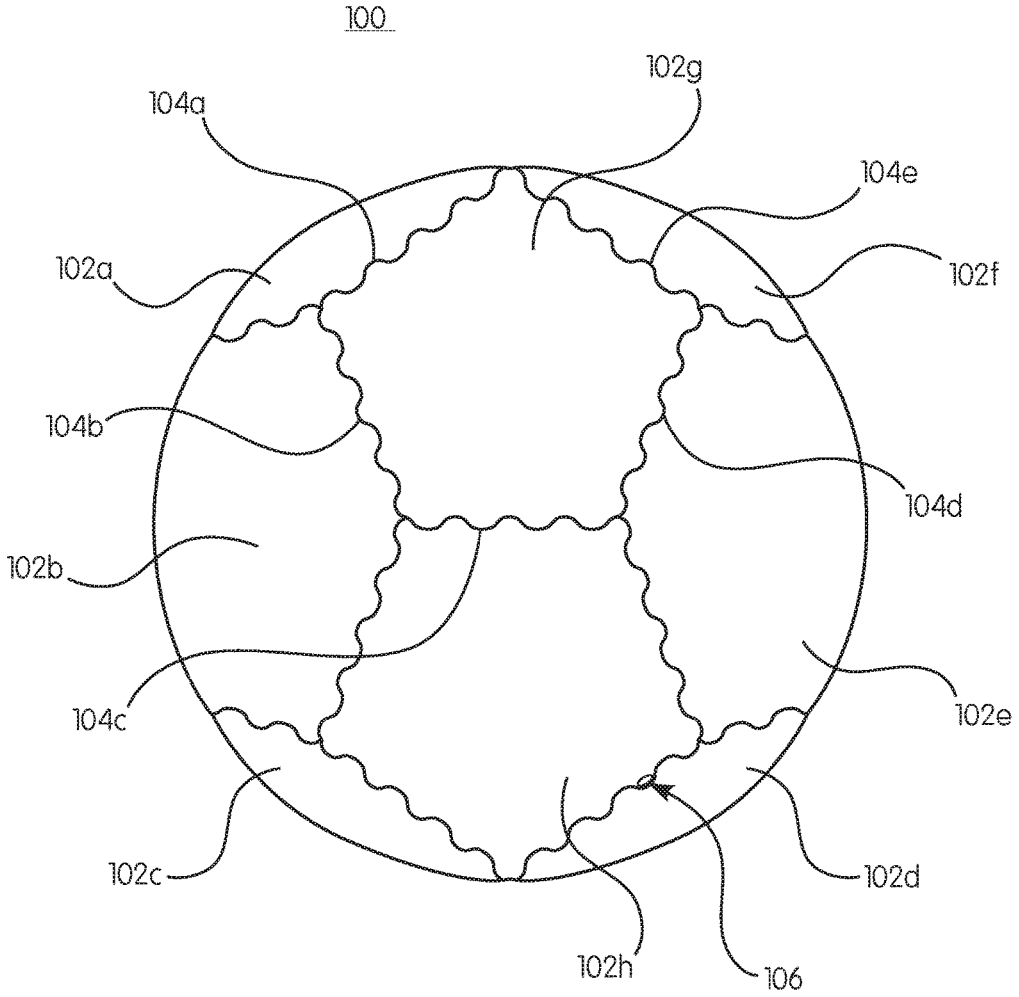
FIG. 1 is a perspective view of an exterior of a sports ball in accordance with an embodiment of the subject application.

Reference will now be made in detail to aspects of the subject application illustrated in the accompanying drawings. Wherever possible, the same or like reference numbers will be used throughout the drawings to refer to the same or like features. It should be noted that the drawings are in simplified form and are not drawn to precise scale. In reference to the disclosure herein, for purposes of convenience and clarity only, directional terms such as top, bottom, above, below and diagonal, are used with respect to the drawings. Such directional terms used in conjunction with the following description of the drawings should not be construed to limit the scope of the subject disclosure in any manner not explicitly set forth. Additionally, the term "a," as used in the specification, means "at least one." The terminology includes the words above specifically mentioned, derivatives thereof, and words of similar import.

The terms "sports ball" or "sports training ball" as used herein refers to a ball used for in sports or for a similar entertainment purpose. In certain embodiments sports balls as disclosed herein may be used for a sport such as lacrosse. In other embodiments, sports balls as disclosed herein may be used for other sports such as baseball, softball, field hockey, handball, team handball, rounders, cricket, polo, jai alai, hurling, or similar sports. In certain other sports collisions between players and equipment (such as pucks, balls, and the like) may also cause injury. It should be understood that in the techniques as described herein may be applied to other geometries than balls, for example pucks and the like. As used herein the words "pad" or "pads" are used interchangeably with the words "panel" or "panels", the words "neighboring" and "adjacent" are used interchangeably.

"About" as used herein when referring to a measurable value such as an amount, a temporal duration, and the like, is meant to encompass variations of ±20%, ±10%, ±5%, ±1%, and ±0.1% from the specified value, as such variations are appropriate. Ranges: throughout this disclosure, various aspects of the invention can be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, and 6. This applies regardless of the breadth of the range.

As used herein, the terms softer or harder refer to the relative hardness of the different materials. The hardness of materials (e.g., plastics) is measured in various ways, for example by the Rockwell hardness test or the Shore (Durometer) hardness test. Such methods measure the resistance of the material toward indentation and provide an empirical value that corresponds to the quality of hardness or softness of a tested material. In addition, as used herein, density refers to the mass of a material divided by its volume.

Figure 2:
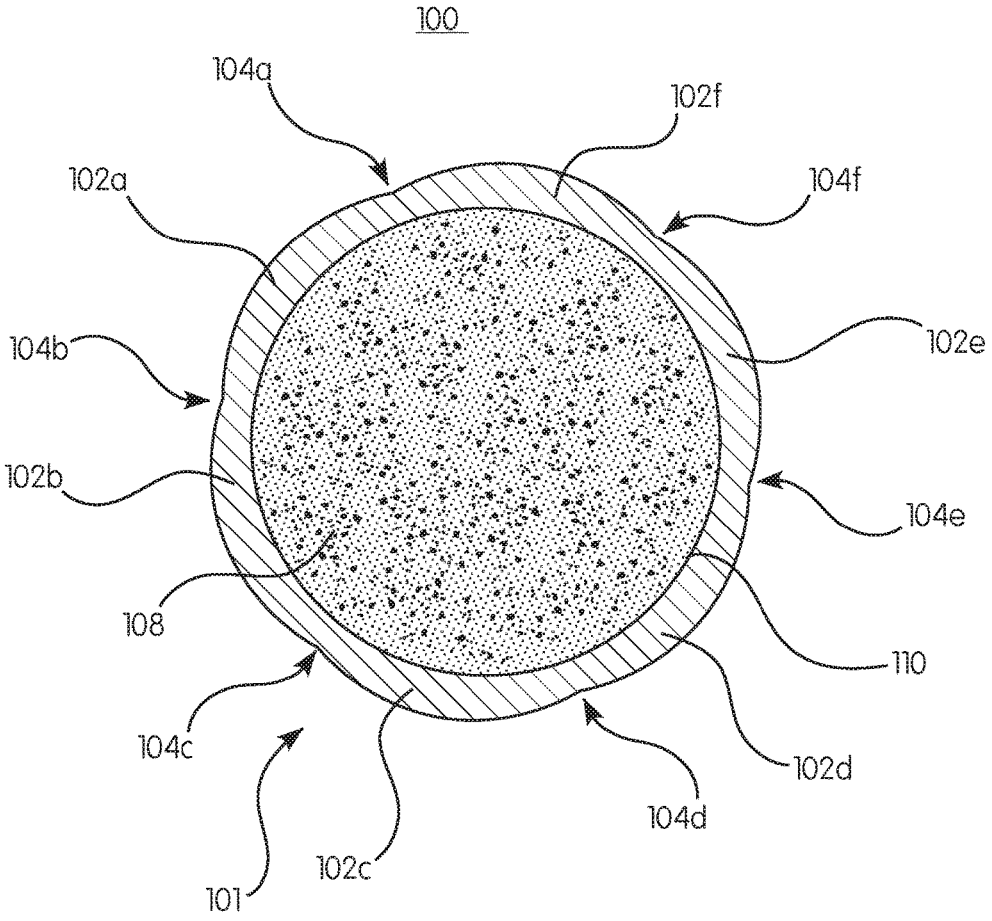
FIG. 2 is a side cross-sectional view of the sports ball as shown in FIG. 1.

Referring now to the drawings wherein aspects of the subject application are shown, FIGS. 1 and 2 are various views of a sports ball 100 in accordance with an embodiment of the present disclosure. FIG. 1 shows an exterior of the sports ball and FIG. 2 shows a cross-sectional view of the sports ball. The sports ball illustrated in FIGS. 1 and 2 has an outer surface made up of twelve pads each of which has a pentagonal shape. Pads 102*a*-102*h* making up the cover of the sports ball are visible in FIGS. 1 and 2. Note that there are four additional pads that are not visible in FIGS. 1 and 2 because they are on the opposite side of the sports ball from the perspective shown. It will be understood by a skilled practitioner that other numbers of pads or shapes of pads may be used in the design of other embodiments of sports balls in accordance with the present disclosure.

The pads may be made up of a suitable material such as synthetic suede, WRP 7400 Rexene with leather grain on surface, or a similar material that exhibits appropriate flexibility, texture, and strength. For an embodiment suitable for a lacrosse training ball, a pad thickness of 1.5 mm is appropriate. In certain embodiments a material may be selected based on the stickiness of its outer surface as certain sports require a particular "grip" associated with a sports ball surface. In certain other embodiments, the outer surface (that is the part of the pads that forms the exterior of the ball) may be treated to create an appropriate grip (or feel) for the players. Such treatment may create a permanent quality on the surface (such as scraping the surface to texture it) or may create a temporary quality on the surface (such as applying an oil, adhesive, or other material to the surface of the sports ball).

The pads may be cut into an appropriate shape (for example, a pentagonal shape) by a hydraulic press (for example, a clicker press) that is instrumented with an appropriate cutting dye that is used to cut the material. Sewing holes may also be punched in the material in preparation for sewing the pads together to form the ball. In certain embodiments, such as the embodiment illustrated in FIGS. 1 and 2, the pads are shaped as regular pentagons (that is, all sides are equal) with each side having a length of e.g., 1.2 inches. Such embodiments provide the advantageous geometrical properties of a regular dodecahedron.

In certain embodiments of the present disclosure a sports training ball appropriate for lacrosse training embodies the technology described in the present disclosure. In such embodiments, the surface of the ball is made up of twelve pads and each of the pads is shaped as a regular pentagon. In order to provide the aerodynamic qualities of a regulation lacrosse ball such a sports training ball must have a circumference between 7.75-8 inches and a weight between 5-5.25 ounces. For such embodiments, the shell of the sports training ball has a substantially spherical shape that has a circumference in the range of about 19.0-21.0 centimeters.

When each of the twelve pentagonal pads is sewn in position on such a sports training ball the portion of each regular pentagon that is visible on the surface of the ball has sides that are each 1 inch in length. The remaining 0.2 inches of length for each side of the pentagons are inside the ball as can be seen in FIGS. 5B-5C.

As indicated in FIGS. 1 and 2 the twelve pads are connected by a plurality of seams that are sewn with a thread. As indicated in FIG. 1 there is a single seam 104*a*-104*e* that connects pad 102*g* on each of its five sides to its five neighboring (or adjacent) pads 102*a*, 102*b*, 102*h*, 102*e*, and 102*f*. A completed twelve-sided (that is, twelve pad) ball with pentagonal pads has a total of 12 seams connecting the pads together. In certain embodiments the seams are sewn with thread such as bees waxed nylon thread or polyester thread. In certain other embodiments, multi-ply (e.g. 3-ply, 4-ply, or 5-ply) nylon thread may be used. Also indicated in FIG. 1 is a hole 106 through which the needle passes when a finishing knot (shown in FIG. 7B as 152) is positioned inside the ball.

FIG. 2 provides a cross-sectional view of the ball illustrated in FIG. 1. Shown in FIG. 2 are six pads 102*a*-102*f* each with a respective seam 104*a*-104*f* connecting it to one of its five neighbors. FIG. 2 also illustrates an interior volume 110 that is substantially filled with a filler 108. In an embodiment as indicated in FIG. 2 the filler provides mechanical stability to the training ball while also providing sufficient mass so that the training ball will have the appropriate mass or weight for the sport for which it is being used. As will be understood by a skilled practitioner, the specific materials and quantity of materials used must be selected to suit the specific sport for which a training ball is being provided. It should be noted that the scope of the present disclosure allows sufficient flexibility to accommodate variations in sports ball regulations as are adopted from time to time by relevant governing bodies.

In an embodiment wherein the sports training ball is being used for lacrosse training the ball should have a weight between 5 and 5.25 ounces. For an embodiment that is appropriate for use as a lacrosse training ball a filler that is a mixture of refined sand and pellets may be used. To generate appropriate pellets an elastic material may be ground up, for example with a sander or similar grinding device. Appropriate elastic materials to grind up in order to generate pellets include an elastomer material such as a natural rubber, a synthetic rubber, and latex. In certain embodiments an interior bladder from a soccer ball or volleyball may be ground up as a source of appropriate rubber pellets. Once ground the elastic material may be sifted to remove dust and to create a set of pellets that are largely uniform pellet width. The width of the pellets is important as it impacts the density of filler and also as pellets that are too small in width have a higher likelihood of leakage through the seams of the ball.

For certain embodiments a filler will be made up of a combination of two or more materials. For an embodiment suitable for a lacrosse ball, a first material and a second material may be selected to have a relative density of a ratio of a density of the first material to a density of the second material in the range of about 0.3-0.5 in order to meet regulation standards. For such an embodiment pellets made of an elastic material that have a width of about 1.0-2.0 mm may be combined with grains of refined sand that have a width between about 0.25 and 1.0 mm. For certain embodiments as appropriate such filler mixtures for a lacrosse ball include 90 grams of refined sand and 55 grams of rubber pellets. For certain embodiments the mixture of grains of sand to pellets may be varied to create a filler that has a total mass in the range of about 140 grams to 150 grams. For other embodiments the mixture of grains of sand to pellets may be varied to create a filler that has a total mass in the range of about 144 grams to 147 grams. For yet other embodiments the mixture of grains of sand to pellets may be varied to create a filler that has a total mass in the range of about 145 grams to 146 grams. In certain embodiments the ratio of the mass of the pellets in the filler to the mass of the sand in the filler is in the range of about 0.55 to 0.65.

Such a filler mixture may be introduced to the interior volume 110 of a shell of the ball by combining the two materials and pouring the combination into the interior volume with a funnel until the appropriate mass of material has been filled into the interior volume.

Figure 3:
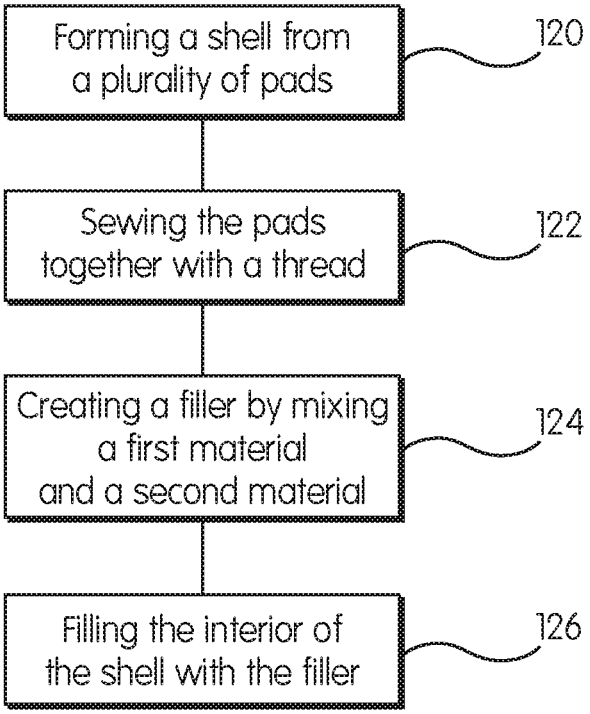
FIG. 3 is a flow chart illustrating a method of manufacturing the sports ball as illustrated in FIG. 1.

FIG. 3 is a flowchart that indicates a series of steps to follow in producing a ball in accordance with the present disclosure. In step 120 a sheet is formed from a plurality of pads. In step 122 the pads are sewn together with a thread or similar sewing material. In step 124 a filler is created by mixing a first material and a second material. In step 126 the interior of the shell is filled with the filler. This step may be performed with a funnel or similar device for moving filler into the interior of the shell.

Figure 4:
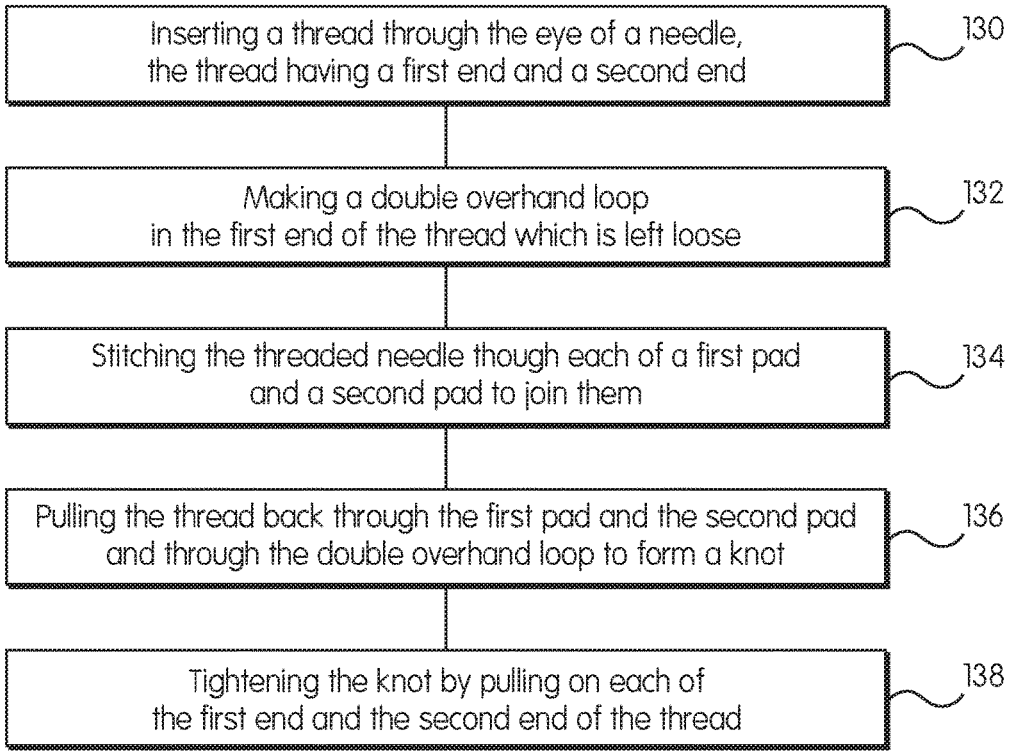
FIG. 4 is a flow chart illustrating a method of tying a starting knot for sewing the sports ball as illustrated in FIG. 1.
Figure 5A:
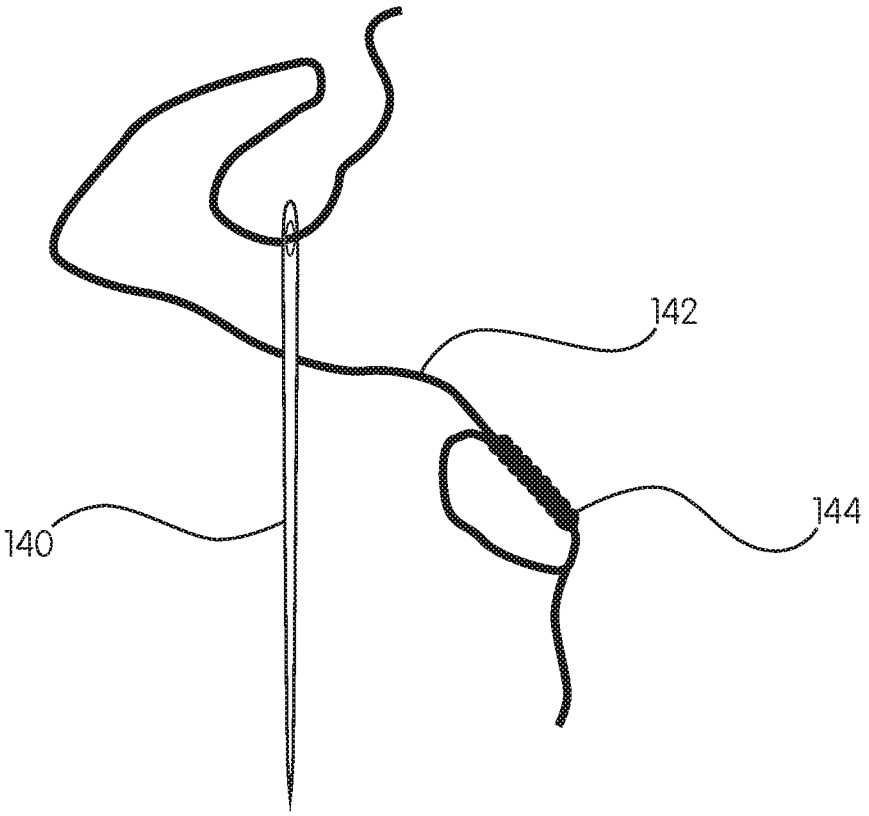
FIGS. 5A-5D are perspective drawings illustrating steps in a process of sewing the sports ball as illustrated in FIG. 1.
Figure 5B:
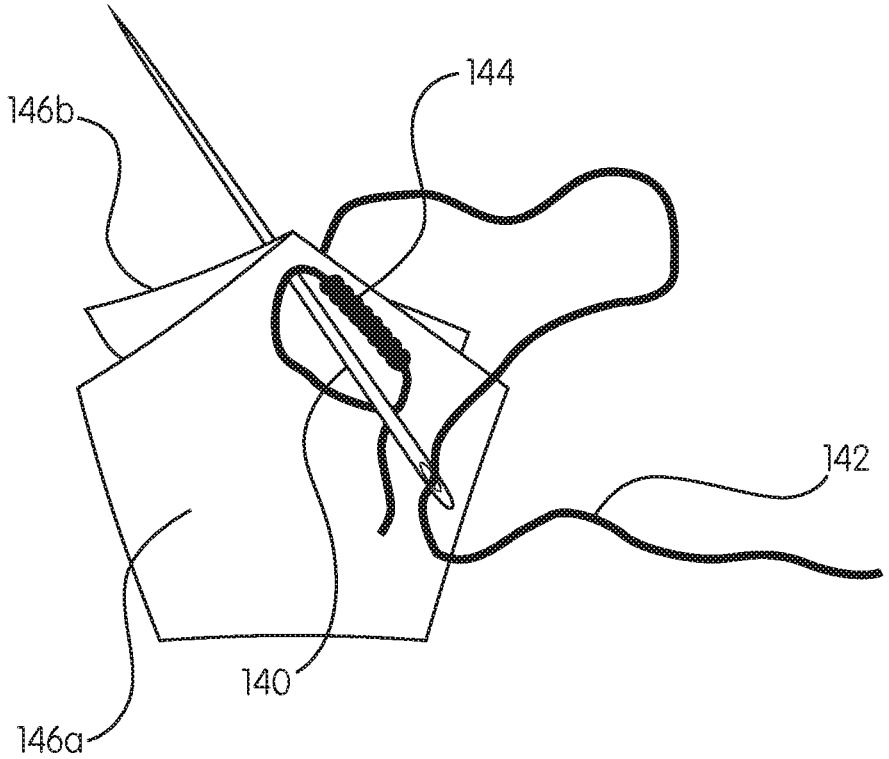
Figure 5C:
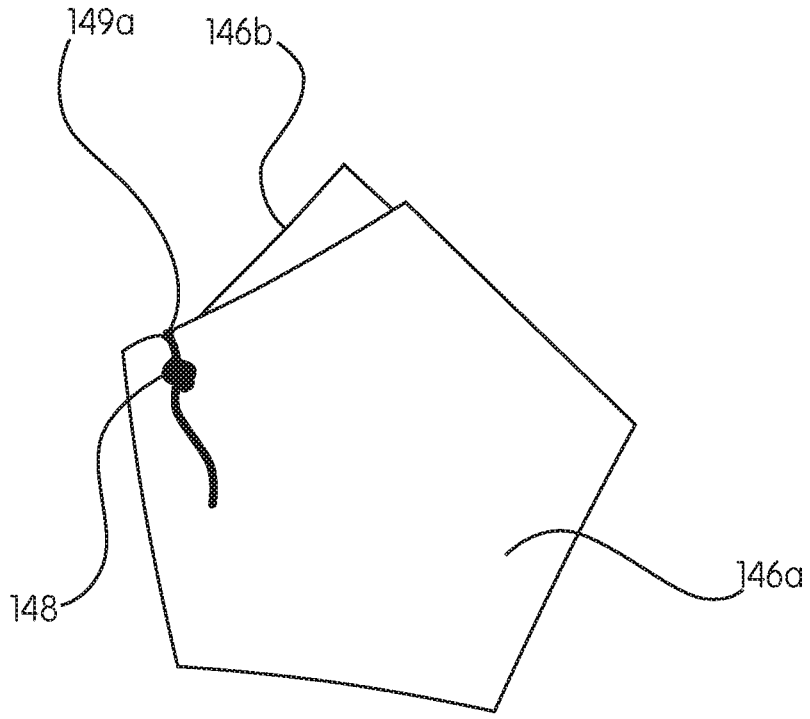

The flow chart shown in FIG. 4 and the perspective views provided by FIGS. 5A-5D illustrate the process of sewing a pad during the manufacture of a ball in accordance with an embodiment. Step 130 of FIG. 4 requires inserting a thread through the eye of a needle, the thread having a first end and a second end. FIG. 5A shows a needle 140, through which a thread 142 is threaded. In step 132 of FIG. 4 a double overhand loop is made to form a knot 144 in the first end of the thread which is left loose. FIG. 5A shows such knot 144.

Figure 5D:
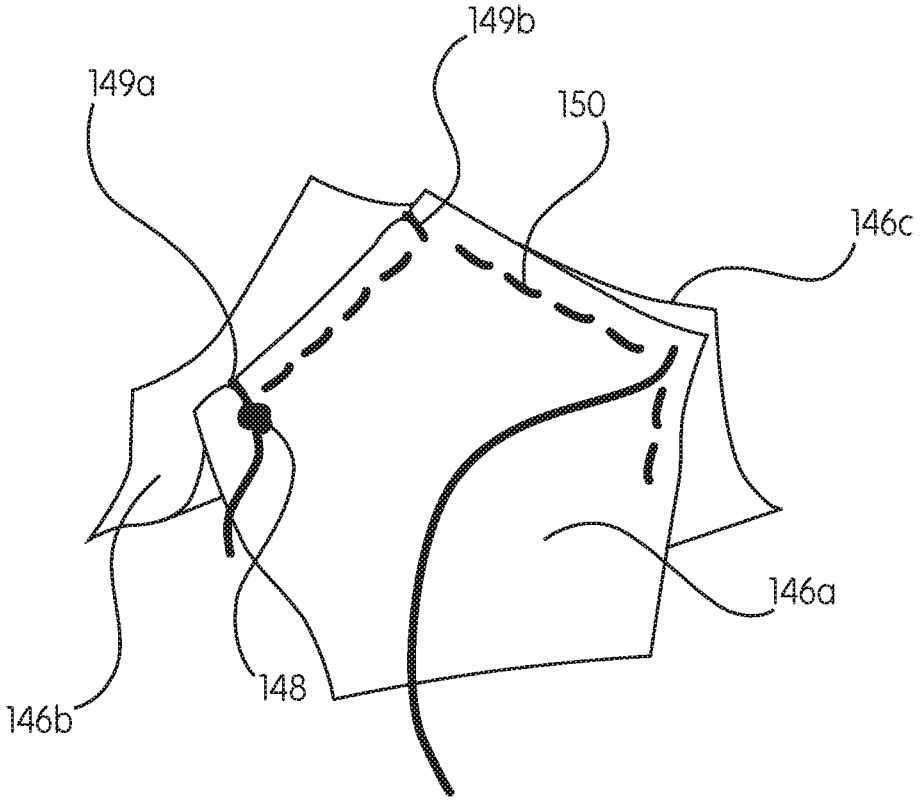

In step 134 stitching of the threaded needle through each of a first pad and a second pad to join them is performed. FIG. 5B illustrates the threaded needle 140 sewing thread 142 through pads 146*a* and 146*b*. The thread is then pulled back through the first pad and the second pad and through the double overhand loop to form the knot 144 that is tied on the interior of the ball at the first sewn hole in a seam. In step 136 of FIG. 4 pulling is performed on the thread so that the thread is sewn back through the first pad 146*a* and the second pad 146*b* and through the double overhand loop to form a knot. FIGS. 5C and 5D illustrate the positions of the pads and seam defined by the thread. FIG. 5D illustrates loop tie downs 149*a* and 149*b* that is made in each of the five vertices of the pentagon 146*a* as the thread sews the pentagon to its five neighboring pentagons. Note that at each vertex a particular pentagon is sewn to two of its neighboring pentagons. The loop tie downs provide added strength to the seams and significantly increase the durability and shape consistency (upon exposure to impact) of the sports training ball. In step 138 tightening of the knot is achieved by pulling on each of the first end and the second end of the thread.

In an embodiment wherein the sports training ball is made up of twelve regular pentagonal pads which are formed into a regular dodecahedron the ball may be advantageously manufactured by sewing a central pad to its five neighboring pad to form a first "half ball." In such an arrangement, the sewing is performed as the following steps:

1) a starting knot is anchored into the central pad, 2) a seam is sewn joining the central pad to each of its five neighbors so that the seam runs completely around the edge of the central pad joining the first neighboring pad to the central pad, the second neighboring pad to the central pad, and so through the fifth neighboring pad, 3) a loop tie down 149*a* and 149*b* is made to provide additional strength the vertex of the pads at each corner after the seam is completed by sewing each neighbor to the central pad a vertex (or corner) of the pentagon is reached, 4) the seam is sewn to continue its line and to run over the seam sewn between the central pad and the first neighboring pad, 5) a finishing knot is tied and the needle is unthreaded, and 6) each of the neighboring pads is sewn onto its two uncoupled neighbors.

The steps thus taken create the "half ball" or hemispherical cup mentioned above. A second half ball is then created following the same steps. The two half balls are then sewn together around an equator line to complete the substantially spherical shape of the ball. Before the final seam is sewn a funnel is used to add filler to the interior volume of the ball. After the interior volume has been substantially filled a finishing knot is tied to complete the sewing of the ball.

Figure 6:
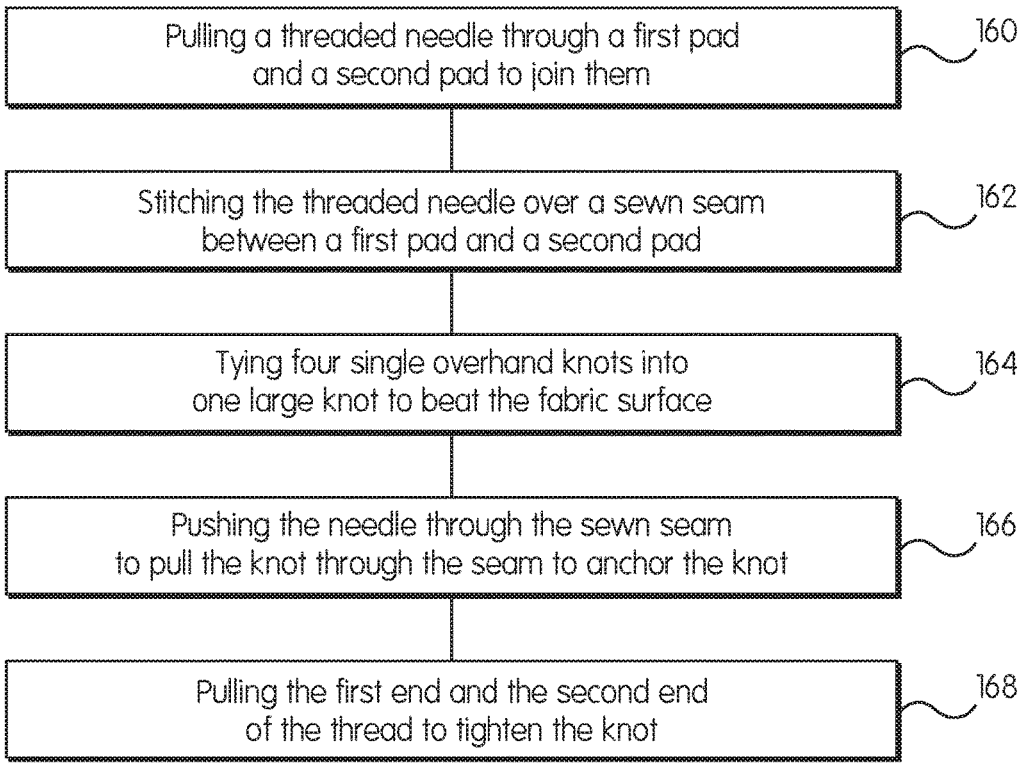
FIG. 6 is a flow chart illustrating a method of tying a finishing knot for sewing the sports ball as illustrated in FIG. 1.
Figure 7A:
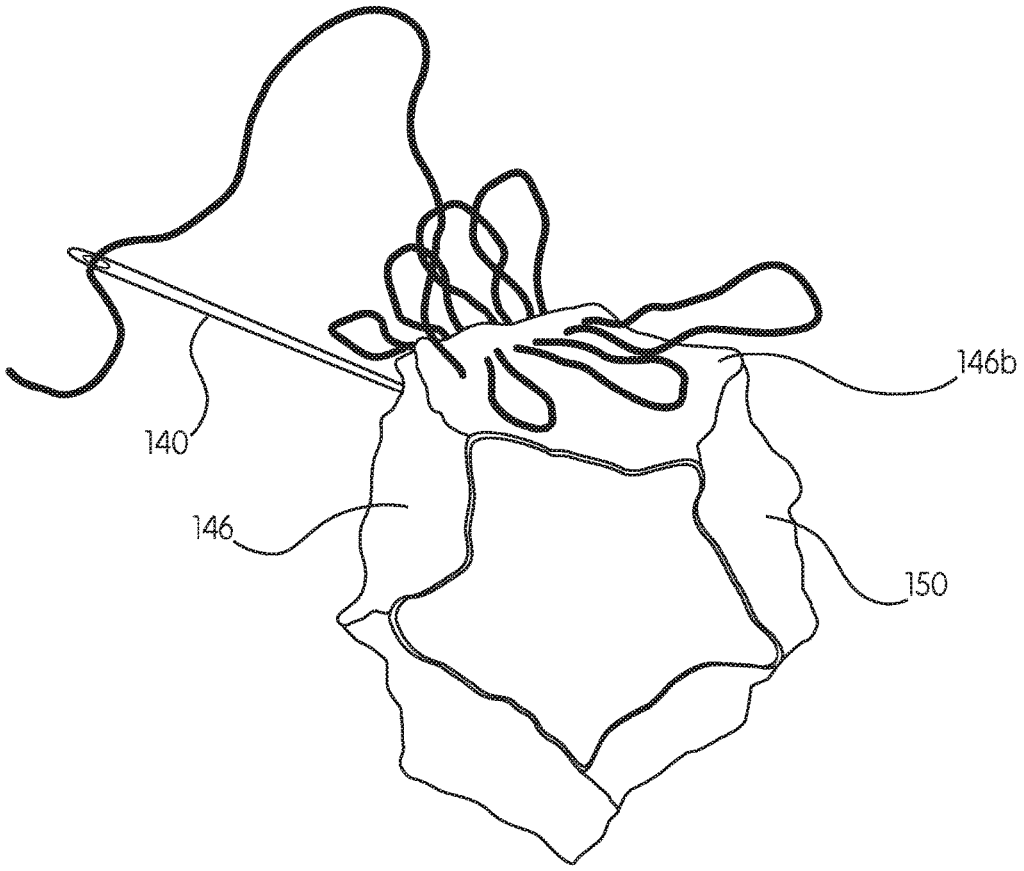
FIGS. 7A-7B are perspective drawings illustrating steps in completing a process of sewing the sports ball as illustrated in FIG. 1.
Figure 7B:
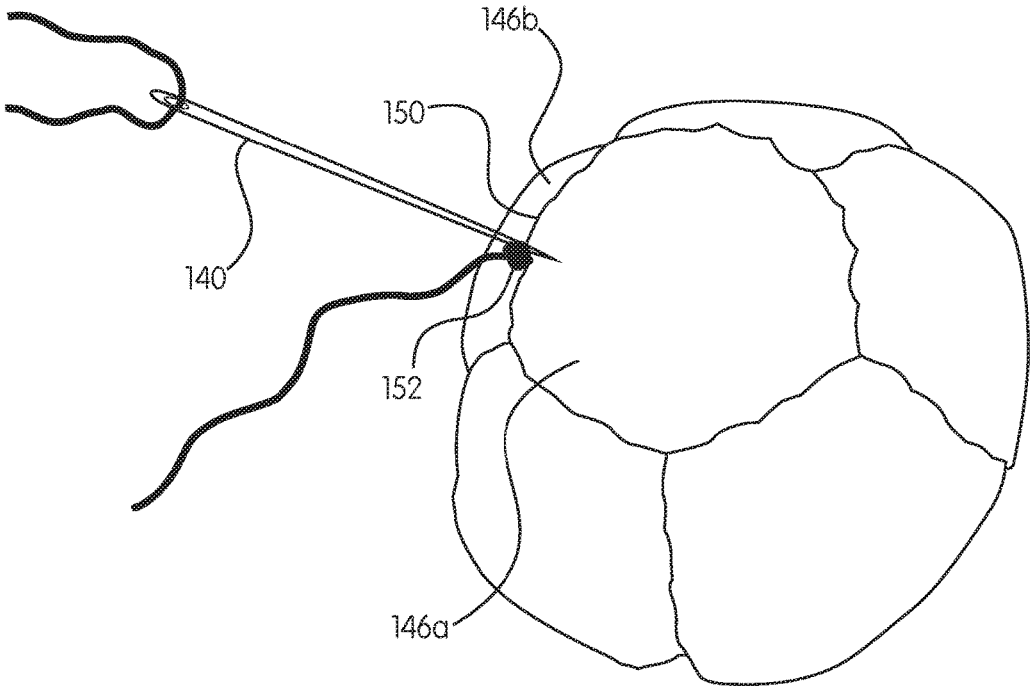

FIG. 6 is a flow chart that describes steps used in tying a finishing knot in accordance with an embodiment of the present disclosure. In step 160, pulling the threaded needle through a first pad and a second pad to join them is performed. In tying a finishing knot step 162 is performed to join two pads. As this is a first step in tying a finishing knot, typically the two pads being joined are the final two pads in the process. FIG. 7A illustrates a ball (in an inside out configuration) prior to inversion when the finishing knot is about to be tied. FIG. 7B illustrates a ball (in an outside out configuration) wherein the finishing knot 152 is being fed by the needle 140 back into the ball through a seam 150 between pads 146*a* and 146*b*. In step 162, stitching of the threaded needle over a sewn seam between two pads (e.g., 146*a* and 146*b*) is performed. In step 164, tying of a series of overhand knots (e.g., four overhand knots) on top of each other to create a large bulbous knot is performed. The large bulbous knot is forced through the seam and acts as an anchor knot.

In step 166, pushing of the needle through the sewn seam is performed so that the anchor knot is secured in the ball. In step 168, pulling of the thread is done so that the thread is pulled tight and the needle is separated from the thread and pulled out of the ball.

In certain embodiments an additional step of rolling the ball is performed after the sewing is completed. Rolling is performed by placing the ball on a flat surface and compressing the ball from above with a compression sheet. The compression sheet is evenly weighted so that the ball experiences pressure across its top and bottom surfaces. In certain embodiments a weight of twenty pounds on the surface of the ball is appropriate. The ball is rolled between the two surfaces so that the ball experiences pressure across each pad. This process promotes an even distribution of material within the ball and stretches the stitches to promote long-term durability for the sports training ball.

Figure 8:
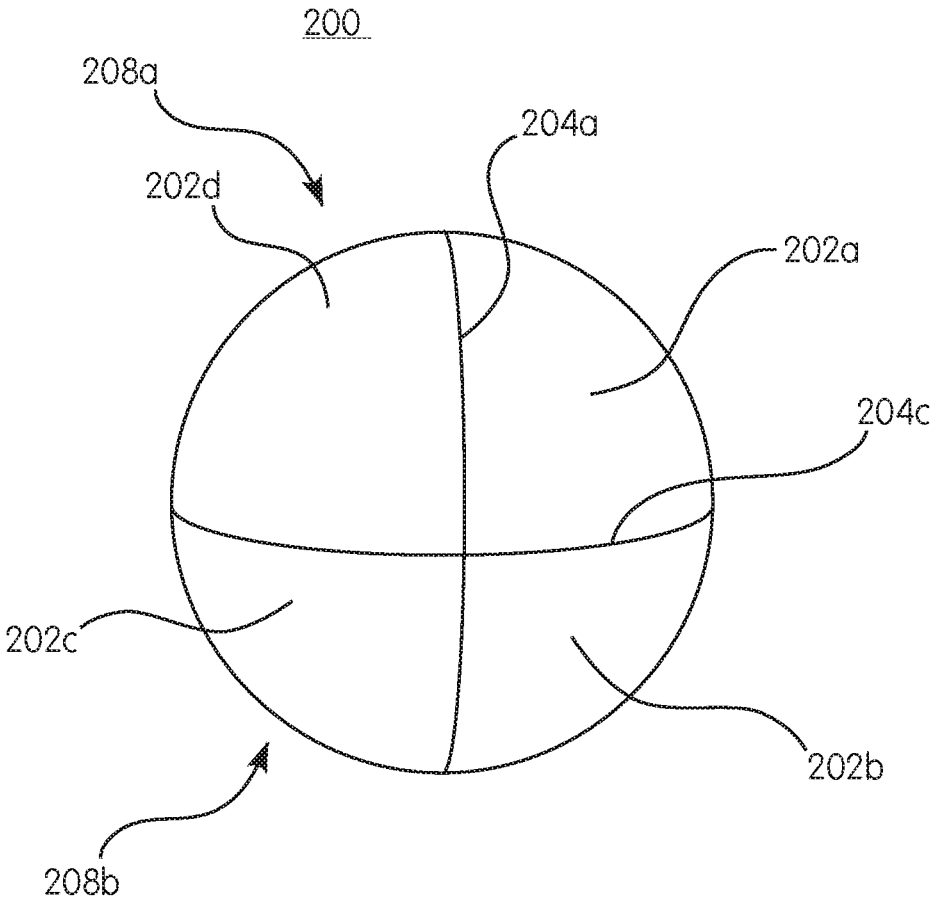
FIG. 8 is a perspective view of a sports ball in accordance with another embodiment of the subject application.
Figure 9:
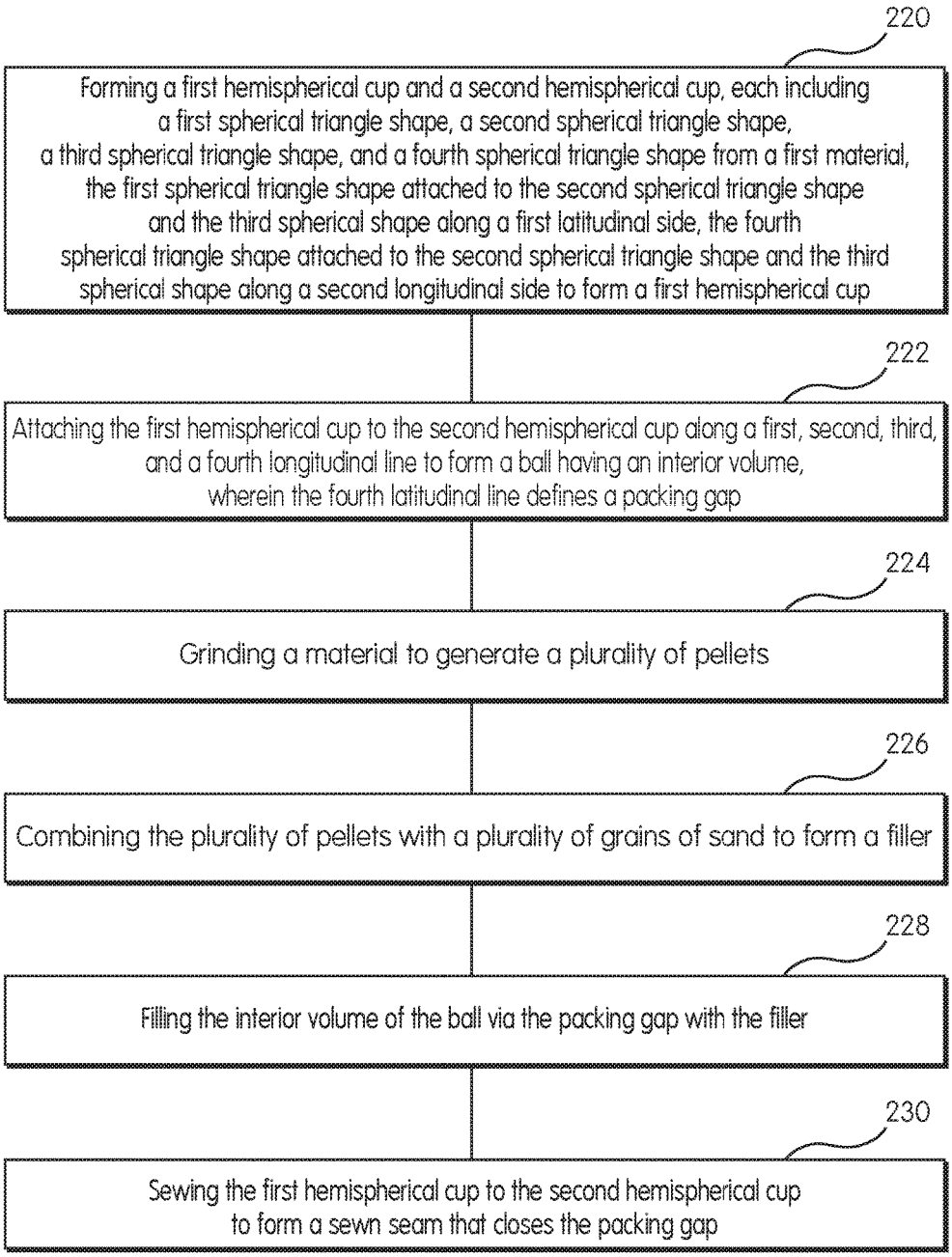
FIG. 9 is a flow chart illustrating a method of assembling the sports ball as illustrated in FIG. 8.

FIGS. 8 and 9 illustrate a further embodiment of a sports training ball and associated method in accordance with this disclosure. FIG. 8 shows a perspective view of a ball 200 with eight pads each of which is shaped as a spherical triangle. A spherical triangle is a triangle formed by three arcs of a great circle of a sphere. Each of the three angles that make up a spherical triangle equals 90 degrees. An example of a spherical triangle is a triangle on the surface of a sphere made by running a line from a point on the equator of the sphere (vertex 1) to a pole of the sphere, running a second line one quarter of the way around the equator of the sphere to a second point on the equator of the sphere (vertex 2), running a third line from the second vertex to the pole (third vertex). An example of a spherical triangle is illustrated in FIG. 8 where 202*a*, 202*b*, 202*c*, and 202*d* are each shaped as spherical triangles.

In an embodiment of a sports training ball as illustrated in FIG. 8 there are eight pads. In FIG. 8, four of the pads 202*a*, 202*b*, 202*c*, and 202*d*, are shown each of which share a seam with four neighboring pads. The four pads of the sports training ball 200 that are not shown in FIG. 8 are in analogous positions on the opposite side of the sports training ball as each of pads 202*a*, 202*b*, 202*c*, and 202*d*. In FIG. 8, seams 204*a* which is a border between pad 202*a* and 202*d* is shown. A sports training ball formed in accordance with such an embodiment may be sewn in a manner that is analogous to the method described above with respect to the sports training ball as illustrated in FIG. 1.

FIG. 9 is a flow chart that indicates steps to be used in manufacturing a sports training ball in accordance with an embodiment as illustrated in FIG. 8. In step 220 a first hemispherical cup 208*a* and a second hemispherical cup 208*b* are formed, each including a first spherical triangle shape 202*a*, a second spherical triangle shape 202*b*, a third spherical triangle shape, and a fourth spherical triangle shape from a first material, the first spherical triangle shape is attached to the second spherical triangle shape along a first latitudinal line 204*c*, the fourth spherical triangle shape is attached to the second spherical triangle shape along a second latitudinal line to form the first hemispherical cup. In step 222 the first hemispherical cup is attached to the second hemispherical cup along a first, a second, a third, and a fourth longitudinal line to form a ball having an interior volume. The fourth latitudinal line defines a packing gap. In an embodiment, the packing gap is a seam 204*c* that is on the seam joining the first hemispherical cup to the second spherical cup. The seam 204*c* that defines the packing gap is unsealed and can be opened to accept a tube (such as from a funnel) that can be used to insert a substance into the interior volume defined by the first hemispherical cup and the second hemispherical cup. In step 224 a material is ground to generate a plurality of pellets. In step 226, the plurality of pellets is combined with a plurality of grains of sand to form a filler. In step 228, the interior volume of the ball is filled via the packing gap with the filler. In step 230, the first hemispherical cup is sewn to the second hemispherical cup to form a sewn seam that closes the packing gap.

Figure 10:
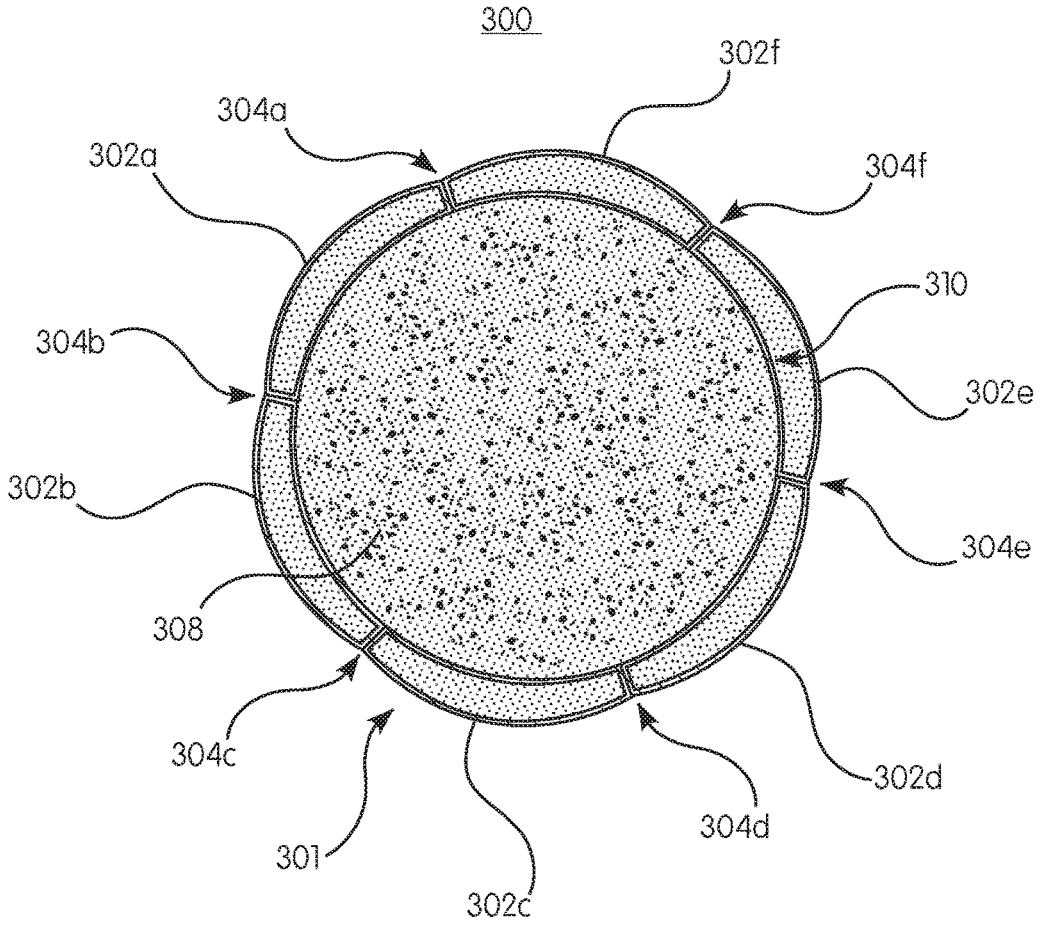
FIG. 10 is a cross-sectional view of a sports ball in accordance with another embodiment of the present disclosure.

FIG. 10 illustrates a sports training ball 300 in accordance with another embodiment of the present disclosure. In accordance with this embodiment a set of pouches that are pentagonal in shape are formed so that each pouch defines a respective pouch interior volume 310. The pouches here indicated in cross-section as 302*a*-302*f* are sewn together at their outer edges 304*a*-304*f* to form a shell 301. The shell is the outer surface of a sports ball while the interior surface of the set of pouches forms a spherical interior volume 308. In certain such embodiments the pouches may be sewn on at more than one contact point to their neighboring pouches. For example, in certain such embodiments, the interior (with respect to the sports training ball) sides of neighboring pouches and also sewn together.

In accordance with an embodiment as illustrated in FIG. 10 the dimensions of the pouches and the spherical interior volume may be selected so that the sports training ball has dimensions appropriate to its sport. That is, such that a sports training ball constructed for lacrosse has the weight and circumference appropriate to a lacrosse ball. In order that such a sports training ball may have a weight appropriate to its training purpose fillers may be selected so that each of the pouch interior volumes and the spherical interior volume of the ball may be filled. It should be understood by a skilled practitioner that such fillers may be a respective single material or a respective combination of materials, e.g., one, two, three or more materials, such as sand and plastic pellets as described above. A specific composition of the filler is selected based on the requirements of weight, size, or impact-absorption for a specific application or sport.

In certain embodiments, the pouch interior volumes are filled with a first material (e.g., sand) and the spherical interior volume is filled with a second material (e.g., ground elastic material). In such embodiments, advantageous properties for the sports training ball may be achieved by filling the pouch interior volumes with a more dense material relative to the material used to fill the spherical interior volume. By distributing the more dense material to the outside of the ball certain aerodynamic qualities may be achieved. This is achieved because the distribution of the heavier material at the outer surface of the ball increases the moment of inertia of the ball. The higher moment of inertia increases the ball's stability in flight against forces due to air currents.

In certain embodiments as illustrated in FIG. 10 a sports training ball has a cover that includes a number of pads (e.g., eight pads, twelve pads) each of which is sewn together to form a cover for the interior volume of the ball. In such embodiments, each pad has a pouch sewn on its respective interior (that is, the side of the pad that is radially closest to the center of the sphere defined by the set of pads). Such pads may be filled with a second material (a weight material) that has a higher density than the filler used to substantially occupy the interior volume of the ball. Such embodiments provide the flight stability benefit mentioned in the preceding paragraphs.

The embodiment of this disclosure as illustrated in FIG. 10 provides a sports training balls that combines two layers of cover material (i.e., the radially outermost and the radially innermost sides of the pouch) that between them capture a dense material (e.g., heavy refined sand) between the two layers. Such an embodiment provides sports ball for which much of the balls weight is isolated at the rim, allowing several things to occur:

1. The innermost and the outermost layers of pouch material together create a bias that provides a much stronger finished product.

2. The two layers of cover material allow very little stretch on the surface of the sports ball. Because the cover (i.e., the outermost layer of the pouch) resists stretching such balls keep their shape even after repeated and stressful use.

3. In an embodiment as illustrated in FIG. 10, the first material and the second material are non-comingling (i.e., not mixed). Such a design isolates the heavy filler (e.g., refined sand) to the outside portion of the ball and the lighter filler (e.g., ground rubber) to the inside of the ball.

Figure 11:
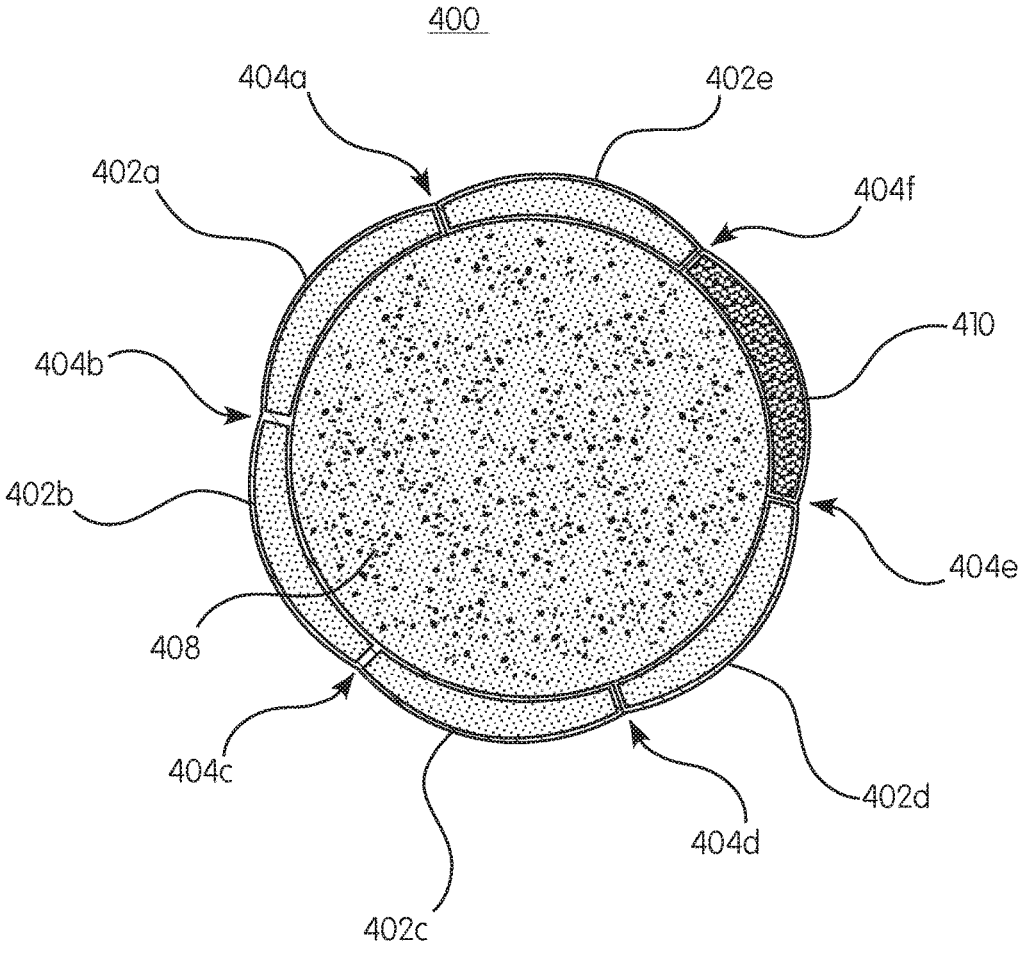
FIG. 11 is cross-sectional view of a sports ball in accordance with yet another embodiment of the present disclosure.

In accordance with yet another embodiment, FIG. 11 illustrates a ball 400 which is similar in general design as the ball 300 illustrated in FIG. 10 but includes certain differences. In accordance with the embodiment illustrated in FIG. 11, one or more of the pouches that make up the set of pouches are designated as load pouches. The other pouches (that is, the pouches that are not load pouches) are designated as cover pouches. For convenience hereafter an embodiment in which there is a single load pouch 410 and cover pouches 402*a*-402*e* is described. The ball 400 is manufactured in a similar manner as the ball 300 and is sewn together at seams 404*a*-404*f*. Similarly to ball 300, the pouches define a spherical interior volume 408 however there are three filler materials used in ball 400. These materials are used to determine the overall weight and aerodynamic properties of the ball 400. A first filler material which typically (though not always) is the least dense of the three filler materials. The first material is used to substantially occupy the spherical interior volume 408 of ball 400. A second material which typically is the densest of the three filler materials is used to substantially fill the load pouch 410. A third material which has a density between that of the first material and the second material is used to substantially fill each of the cover pouches. Such an embodiment provides a ball that has a center of mass displaced relative to the center of the spherical ball. Because of such displacement the ball will tumble through the air when thrown and will naturally deviate from the path that would be followed by a similar spherically symmetrical sports training ball. Such deviations are useful for certain applications such as training a baseball batter to hit a baseball that curves, training a baseball catcher to catch a ball that curves, or to meet similar training challenges. The shape, size, texture, and other qualities of the pouches and the mass and other qualities of the fillers may be selected for similarity to a training ball appropriate to a particular sport and to determine the aerodynamic qualities of the sports training ball in flight. For example, changing the shape and mass of one or more of the surface pouches or the distribution of mass in the interior volume of the sphere alters the flight characteristics of the ball in comparison to the flight characteristics of a ball of similar overall weight and size.

A detailed description of the process used to sew a sports ball in accordance with a further embodiment follows. From the starting knot to the finish knot the sewing techniques used to produce a sports training ball in accordance with the present disclosure distinguish the sports training balls from earlier sports training balls. The particular care in the sewing process is necessary for a sports training ball to withstand the high stresses of sports such as lacrosse. Lacrosse training balls require a much stronger thread and a very special way of tying the starting knots and closure knots so that even if the fabric fails, the thread will not fail. This is very important in a handmade ball that can contain as much as 24 knots to complete and also a ball that must withstand throws and collisions of up to 70 mph which is required in lacrosse play.

In certain embodiments of a sports training ball as described herein there are three knots which tied in the course of sewing the ball. These are: a starting knot, an ending knot, and a finishing knot. The starting knot is tied when an initial pad is sewed to its neighboring pad. It is tied before the sewing starts in order to anchor the thread onto the ball. The ending knot is tied after a circuit has been sewn around the edge of the initial pad so that each of its neighboring pads is sewn to the initial pad. The finishing knot is tied after the ball has been sewn shut. It is tied outside the ball and forced back through a seam in the ball by the sewing needle.

A starting knot is made by making a double overhand loop in the thread which is left loose. The thread is then pulled through the pads that are to be joined by a needle. An overhand loop is then tied by going over the two pads and then back through the loose knot. When the starting knot is correctly completed, both sides of the knot and thread are pulled tight. A starting knot thus tied will not pull apart even if the material covering the outer surface of the ball fails.

An ending knot is created through a similar tying process as that used in tying the starting knot. The finishing knot of a sports ball in accordance with the present disclosure is unique in that the technique used to tie the knot insures that there is very little chance of a knot failure or loosening. When a sports training ball as disclosed herein is used in training there is a great amount of force on all seams of the ball. This force is radiated out to the vertices of the pads that cover the surface of the ball. The knots and loops employed in the sewing technique provide the main mechanical resistance to distribute and counter such forces. That is to say when the ball experiences an impact at a high velocity the force that is imparted to the ball upon collision is distributed on the vertices of the pads. Because of this the finishing knot in accordance with an embodiment of the disclosure cannot be located in a vertex of the ball as that would encourage the knot to fail. To overcome this problem, the finishing knot has been designed to close in the middle of a previously sewn line. This can be seen, for example, in FIG. 1 where the finishing knot 106 is located in the interior of the ball at the center of the seam between pads 102*d* and 102*h*. By positioning the ball about a middle of a previously sewn line the finishing knot is not subject to the forces that occur in the vertices of the ball due to radiated stress as that stress is passed to the corners.

FIG. 7B shows the finishing knot in the middle of a previously sewn line prior to being forced through the seam in the ball. It is a relatively large knot as it is an anchor knot. The needle is shown going back through the same opening as the knot. The needle is then passed through the ball and is brought out the other side of the ball between previous stitches so that it can be cut free of the ball. When the needle is pulled from the opposite side of the ball, the finishing knot is "popped" inside and disappears inside the ball. The finishing knot is left anchored at the place of the last stitch made and in the middle of a previously sewn line. Therefore the stress of impact does not in any way inhibit the strength of the finishing knot.

In accordance with certain embodiments of sports training balls as herein described additional strength and durability are obtained by utilizing loop tie downs that strengthen the ball at vertices where pads meet. For example, in certain lacrosse training balls that are implemented as regular dodecahedrons there are twenty vertices. In order to provide maximum strength and durability each vertex has an associated loop tie down. These loop tie downs create an internal structure or frame work (an "internal truss system"). As each line of thread is sewn into the ball, the thread becomes locked down to the interior of the pads through a series of cross over loops at each corner. This technique of cross over loops allows for three vertices to join so that the tension and line length is consistently maintained from one thread to the thread associated with a neighboring pad. Consistency in line length is an important factor in producing a near optimally round sphere. Without line length consistency, the ball would not achieve the desired roundness necessary for a sports training ball. The starting knot, the end knot, and the finishing knot provide durability to the knots and the outer surface of the sphere that defines the ball. The internal truss system of loop tie downs is a key to the maintaining the ball shape in spite of numerous impacts associated with sports training.

It will be appreciated by those skilled in the art that changes could be made to the various aspects described above without departing from the broad inventive concept thereof. It is to be understood, therefore, that the subject application is not limited to the particular aspects disclosed, but it is intended to cover modifications within the spirit and scope of the subject application as defined by the appended claims.

We claim:

1. A lacrosse training ball comprising:

a shell defining an enclosure having an interior volume, the shell including a plurality of pads connected along a plurality of seams sewn with a thread having a finishing knot; and a filler consisting essentially of a mixture of a first material being a plurality of pellets formed by a process comprising grinding an elastic material, and a second material being a plurality of grains of sand that substantially occupies the interior volume, wherein the shell has a substantially spherical shape having a circumference in the range of 19.0 to 21.0 centimeters, and wherein the lacrosse training ball has a weight of 5 ounces to 5.25+/−5% ounces.

2. The lacrosse training ball of claim 1, wherein the thread is five-ply bees wax thread.

3. The lacrosse training ball of claim 1, wherein a ratio of a density of the first material to a density of the second material is in the range of about 0.3-0.5.

4. The lacrosse training ball of claim 1, wherein each of the plurality of pellets has an overall width of about 1.0-2.0 mm.

5. The lacrosse training ball of claim 1, wherein each of the grains of the plurality of grains of sand have an overall width of about 0.5-1.0 mm.

6. The lacrosse training ball of claim 1, wherein the elastic material is a polyisoprene, latex, natural rubber, or synthetic rubber.

7. The lacrosse training ball of claim 1, wherein the ratio of the mass of the first material to the mass of the second material is in the range of about 0.55 to 0.65.

8. The lacrosse training ball of claim 1, wherein the plurality of pads consists of twelve pads and each pad has a pentagonal shape.

9. The lacrosse training ball of claim 1, wherein the plurality of pads consists of eight pads and each pad is in the shape of a spherical triangle.

10. The lacrosse training ball of claim 1, wherein each of the plurality of pads has a respective pouch attached to a radially inward side of the respective pad, each pouch defining a respective pouch interior volume.

11. The lacrosse training ball of claim 10, further comprising a weight material substantially occupying each of the pouch interior volumes, the weight material having a density, and wherein the density of the weight material is greater than the density of the filler.

12. A method of making the lacrosse training ball of claim 8 comprising:

(a) forming a first hemispherical cup and a second hemispherical cup from a first material, wherein each cup comprises six pentagonal pads and is made by the steps comprising: anchoring a starting knot to a central pentagonal pad, sewing a seam joining the central pad to each of five neighboring pentagonal pads so that the seam runs around the perimeter of the central pentagonal pad joining a first neighboring pentagonal pad to the central pentagonal pad, a second neighboring pentagonal pad to the central pentagonal pad, a third neighboring pentagonal pad to the central pentagonal pad, a fourth neighboring pentagonal pad to the central pentagonal pad, and a fifth neighboring pentagonal pad to the central pentagonal pad, and sewing each of the neighboring pentagonal pads to its two uncoupled neighboring pentagonal pads;

(b) attaching the first hemispherical cup to the second hemispherical cup along an equator line to make a substantially spherical shell having an interior volume;

(c) before the equator line is completely sewn, filling the interior volume of the ball with a filler consisting essentially of a mixture of a plurality of pellets ground from an elastic material and a plurality of grains of sand; and (d) tying a finishing knot to complete attaching the first hemispherical cup to the second hemispherical cup to make the lacrosse training ball.

13. The method of manufacturing the lacrosse training ball of claim 12, wherein plurality of pellets consists essentially of pellets having an overall width of about 2-4 mm.

14. The method of manufacturing the lacrosse training ball of claim 12, wherein the ratio of a mass of the plurality of pellets in the filler to a mass of the plurality of grains of sand in the filler is in the range of about 0.55 to 0.65.

15. The method of manufacturing the lacrosse training ball of claim 12, wherein the shell has a substantially spherical shape having a circumference in the range of about 19.0 to about 21.0 centimeters, and wherein the lacrosse training ball has a weight of about 5 to about 5.25 ounces.

16. The lacrosse training ball of claim 1, further comprising an internal truss system of loop tie downs.

17. The lacrosse training ball of claim 1, wherein the sports training ball can withstand a collision of greater than 70 mph.

18. The lacrosse training ball of claim 1, wherein the plurality of pads are made from a synthetic suede or synthetic leather.

19. The lacrosse training ball of claim 1, wherein the thread is a multi-ply nylon thread.

* * * * *